United States Patent [19]

Runnels

[11] Patent Number: 4,650,365

[45] Date of Patent: Mar. 17, 1987

[54] WATERTIGHT MANHOLE INSERT

[75] Inventor: Franklin D. Runnels, Conroe, Tex.

[73] Assignee: FRW Industries, Inc., Conroe, Tex.

[21] Appl. No.: 738,564

[22] Filed: May 28, 1985

[51] Int. Cl.[4] ..... E02D 29/14

[52] U.S. Cl. ..... 404/25; 404/4; 404/26

[58] Field of Search ..... 404/2, 4, 25, 26; 210/163, 164, 165, 166; 52/19, 20, 21

[56] References Cited

U.S. PATENT DOCUMENTS

| | | | |
|---|---|---|---|
| 3,712,009 | 1/1973 | Campagna | 52/20 |
| 3,798,848 | 3/1974 | Campagna | 52/20 |
| 3,969,847 | 7/1976 | Campagna et al. | 52/1 |
| 3,973,856 | 8/1976 | Gaglioti | 404/25 |
| 4,030,851 | 6/1977 | Graybeal | 52/21 X |
| 4,067,659 | 1/1978 | Campagna et al. | 404/25 |

OTHER PUBLICATIONS

Advertising brochure of FRW Industries, Inc. of Conroe, Texas for an Inflow Protector-Cover TM.

*Primary Examiner*—Stephen J. Novosad
*Assistant Examiner*—Thomas J. Odar
*Attorney, Agent, or Firm*—Arnold, White & Durkee

[57] ABSTRACT

A watertight manhole insert is provided for preventing rainwater from entering a sanitary sewer system through manhole covers. The insert includes a shallow, dish-shaped body and a mounting flange designed to rest upon the supporting flange of a manhole frame. A recess is formed in the bottom of the body portion and includes a valve for releasing pressure which builds up beneath said insert. The valve is shielded such that it will not be struck by a manhole cover sliding across said insert. Additionally, the valve can be used as a handle to remove the insert from a manhole.

6 Claims, 4 Drawing Figures

WATERTIGHT MANHOLE INSERT

BACKGROUND OF THE INVENTION

The present invention relates to manhole closure assemblies and, more particularly, to watertight inserts which prevent storm water from draining into a sanitary sewer through a manhole.

In many urban areas, the increased construction in buildings, streets, and parking lots has significantly decreased the ground surface area which is available for absorbing moisture from rain or snow. Accordingly, this water must be drained off and disposed of through suitable means. In some instances, it is possible to simply collect this water and discharge it into a city's sanitary sewer system. However, sewer systems must be sized such that they can accommodate the maximum influent which can be expected at any time. Accordingly, in those areas receiving a substantial amount of rain, the sewage treatment plant must be increased in size dramatically which results in exceptionally high costs. Thus, it is often advantageous to separately collect and dispose of storm water apart from the sanitary sewer system. This is often done through separate storm sewers.

During rainy weather, an average manhole in a sanitary sewer system can contribute from 3,000 to 12,000 gallons per day of rainwater to the treatment system. Accordingly, in those areas where a separate storm sewer is provided, it has been found advantageous to provide a means for preventing storm water from entering the sanitary sewer system through manholes.

On such system is disclosed in U.S. Pat. No. 4,067,659 issued Jan. 10, 1978. This patent discloses a manhole closure assembly comprising a cover section including a downwardly depressed central portion. A circular mounting flange extends outwardly from the depressed central portion and the flange is adapted to rest upon the inwardly directed manhole cover supporting flange of an annular manhole frame. The downwardly depressed portion of the cover section is depressed in an amount that exceeds the path of spin of a manhole cover resting upon the supporting flange of the annular manhole frame. A first valve member is secured to the cover section to relieve pressure inside the manhole when pressure therein exceeds a predetermined amount. While this patent discloses a system which effectively prevents rainwater from entering the sewer system through the manhole cover, it is plagued by several problems.

For example, since the closure assembly is deep enough to allow the manhole cover to spin freely above the bottom of the closure assembly, the assembly can hold a significant amount of water. This makes it difficult to remove the assembly when it is necessary to enter a manhole. Additionally, when the assembly is formed from a plastic such as polyethylene, it can become softened in hot weather and the weight of any water collected in the assembly can cause it to deform such that it falls into the sewer system through the manhole. The assembly can then travel through the sewer where it can act as a plug if it strikes any object in the sewer system.

Additional manhole disclosure assemblies are disclosed in U.S. Pat. Nos. 3,712,009; 3,798,848; 3,969,847; and 3,973,856. Each of these assemblies comprises a generally planar cover which reduces the amount of water which the assembly will collect. However, each of these closure assemblies requires a separate support ring or flange which is often difficult to install. Additionally, these disclosures are easily damaged when a manhole cover is lifted for removal. The vent valves in the closures often protrude above the surface of the closure and are also easily damaged by the manhole cover.

Accordingly, it would be a significant advancement in the art to provide a means for preventing rainwater from entering a sewer system through a manhole cover which is easy to install and remove. It would be a further advancement to provide such a means which was not easily damaged when a manhole cover is positioned or removed. Such a system is disclosed and claimed herein.

BRIEF SUMMARY OF THE INVENTION

The present invention provides a watertight manhole insert for preventing rainwater from entering a sewer system through a manhole cover. The insert includes a dish-shaped body member with an outwardly extending flange designed to correspond to the supporting flange of a manhole frame. In the preferred embodiment, the body is depressed about five to six inches below the plane defined by the flange member. The dish shape of the insert and this depth allow the insert to act as a cam to assist in guiding a manhole cover into position on top of the manhole. Additionally, the shallow depth limits the amount of water which can be accumulated on top of the insert to minimize the weight which it must support.

A recess is formed in the bottom of the body portion in which a valve is located. The valve is designed to release pressure above a predetermined amount which may occur in the manhole beneath the insert. The valve is located in the recess such that it cannot be damaged by the manhole cover as it slides across the body of the insert.

In the preferred embodiment, the recess and valve member are sized such that an annular space is formed within the recess around the valve. A person can thus insert his fingers down into the recess and grasp the valve such that it can be used as a handle to lift the insert from the manhole.

A sealing means such as a strip of closed cell neoprene foam rubber is positioned on the lower surface of the mounting flange such that an essentially watertight seal is formed between the insert and the manhole frame to prevent water from seeping down around the edges.

DETAILED DESCRIPTION OF THE PREFERRED EMBODIMENT

The present invention provides a watertight insert which can be placed in a manhole beneath the manhole cover to prevent rainwater from entering a sanitary sewer system through the manhole cover. The insert is easy to install and remove such that it does not interfere with the function of the manhole. Through use of the insert, the volume of influent to a sewage treatment facility is decreased thus allowing for a more inexpensive operation.

Figure 1:
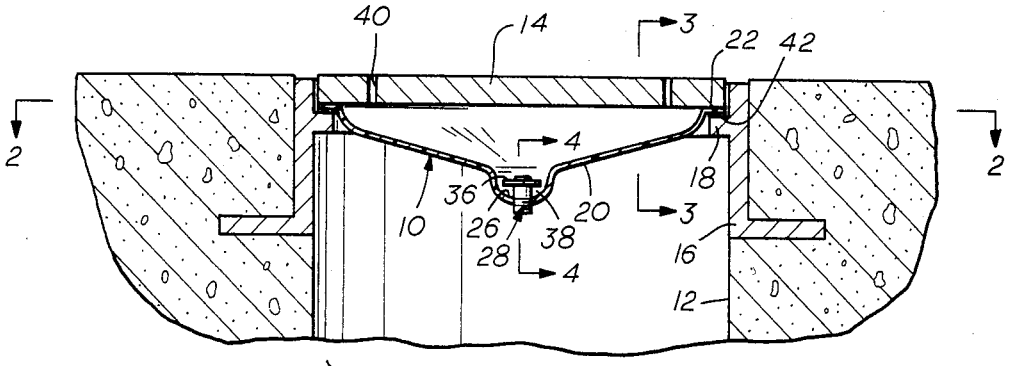
FIG. 1 is a cross-sectional view of a manhole insert of the present invention in place in a manhole.

Reference is now made to the drawings which illustrate a preferred embodiment of the present invention. With reference first to FIG. 1, a manhole insert 10 is positioned in a manhole beneath a manhole cover 14. The insert is supported by the manhole frame 16 which also supports the manhole cover 14 on a supporting flange 18.

Insert 10 includes a generally dish-shaped body portion 20 and a circular mounting flange 22 around the outer edge thereof. Mounting flange 22 is designed such that it overlies supporting flange 18 of manhole frame 16 beneath cover 14.

Figure 3:
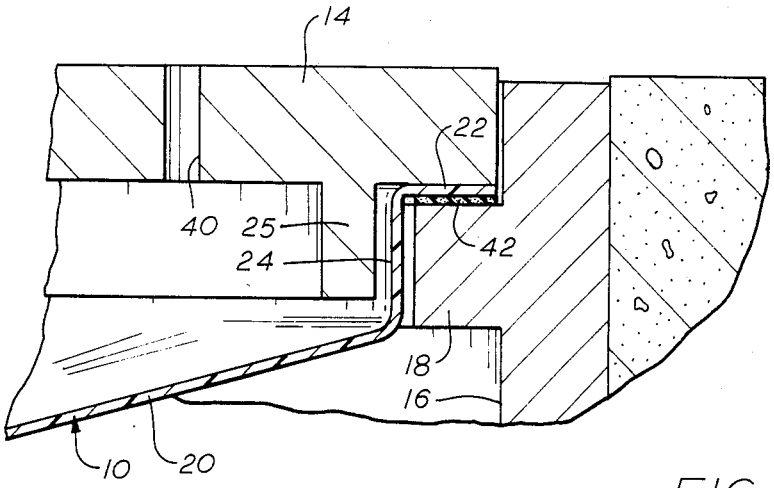
FIG. 3 is an enlarged cross-sectional view of a second preferred embodiment as it would be viewed taken along line 3—3 of FIG. 1.

In the a second preferred embodiment as illustrated in FIG. 3, insert 10 includes a generally vertical wall 24 between mounting flange 22 and body 20. This embodiment is used when manhole cover 14 includes a drop ring 25 which extends below supporting flange 18.

A cup-shaped recess 26 is formed in the bottom of body 20 of insert 10. A valve 28 is positioned in recess 26 and is designed such that it will release any pressure which builds up in the manhole beneath insert 10 while not limiting the amount of water which can pass down through the insert.

Figure 4:
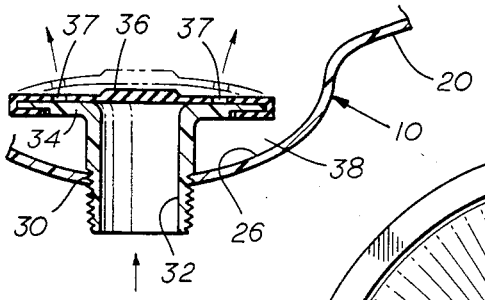
FIG. 4 is an enlarged cross-sectional view taken along line 4—4 of FIG. 1.
Figure 2:
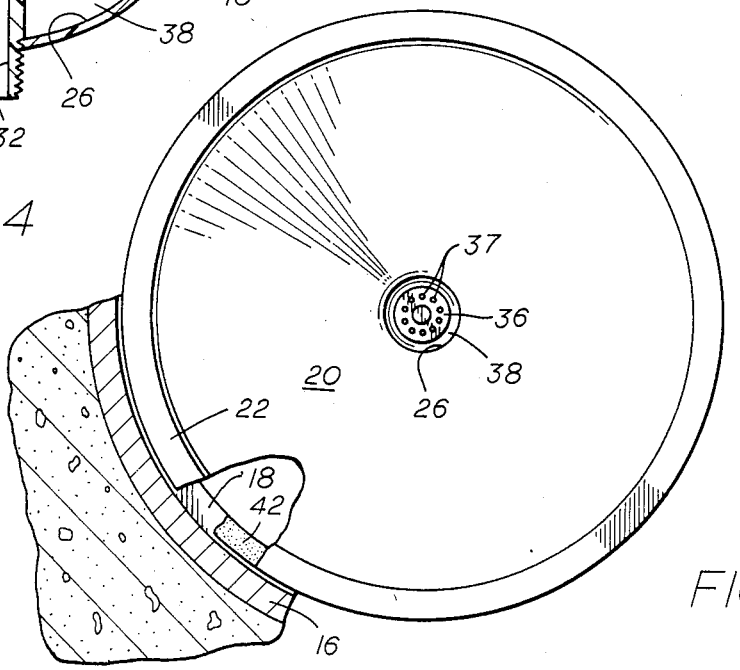
FIG. 2 is a partially broken away top plan view of the manhole insert of the present invention.

In the preferred embodiment, valve 28 is threaded into an aperture 30 formed in the bottom of recess 26 (see FIG. 4). Valve 28 includes a cylindrical stem 32 and a head 34. A flexible cap 36 is positioned over the head 34 and includes a plurality of holes 37 (see FIG. 2).

By controlling the seal formed by the treads, the leak down rate of insert 10 can be controlled. A fluid tight seal prevents any water from leaking around valve 28. Alternatively, the seal can be formed to allow a leak down rate of up to about 10 gallons per day. This eliminates ponding over the cover and insert without allowing a significant amount of water into the sanitary sewer system. While some minor leak down can occur, this embodiment is still considered a watertight insert.

Flexible cap 36 is generally biased downward such that it sealingly engages the top of stem 32. As pressure builds up beneath insert 10, the pressure raises the flexible cap 36, as illustrated by the broken lines in FIG. 4, such that the gas can pass between the cap 36 and head 34 and exit through holes 37. A suitable valve is the Snap-Cap Diffuser manufactured by EnviroQuip Corp., of Loveland, Ohio.

In the preferred embodiment, sewer gas at 1 p.s.i. is vented through valve 28.

Valve 28 and recess 26 are sized such that an annular space 38 is maintained around valve 28. Accordingly, an individual can easily insert his fingers in the annular space 38 and grasp valve 26 to lift insert 10 from the manhole when it needs to be removed.

Additionally, valve 28 can easily be unscrewed and removed to allow any accumulated water to drain through insert 10. This facilitates removal of insert 10 and also provides a means for removing any accumulated dirt or debris.

A strip of sealing material 42 is included on the bottom of mounting flange 22 such that it can form a watertight seal with supporting flange 18. Thus, any water which enters the manhole through holes 40 in manhole cover 14 will be caught by insert 10 and will not be allowed to enter the sewer system around the edges in the insert. In the preferred embodiment, sealing material 42 is a strip of closed cell neoprene. However, other types of material can also be used.

As can be appreciated from the foregoing, the present invention provides a unique insert for preventing rainwater from entering a sanitary sewer system through manhole cover. The insert is designed such that it is easy to install and remove. Additionally, because of its shallow depth, only a relatively small amount of water can be trapped above the insert. Thus, excessive weights are not achieved which could cause the insert to deform and fall into the sewer system through the manhole. It is easier to remove the insert since only a small amount of water can be trapped above it.

The shape of the body is designed such that it can help guide a manhole cover onto and off of the manhole frame. The curved nature of the body of the insert causes the manhole cover to slide along and assume a normally horizontal position on top of the manhole.

The recess formed in the bottom of the body of the insert shields the valve means such that it is not damaged as a manhole cover slides across the insert. Additionally, the annular space surrounding the valve can allow the valve to act as a handle to facilitate removal of the insert.

While the invention has been described with respect to the presently preferred embodiments, it will of course be appreciated by those skilled in the art that modifications or changes could be made to the insert of the present invention without departing from its spirit or essential characteristics. For example, the size of the mounting flange can be modified for different manhole frames and the slope of the curvature of the body can be easily be modified. Additionally other shapes of recesses can be used in the bottom of the insert. Accordingly, all modifications or changes which come within the meaning and range of equivalency of the claims are to be embraced within their scope.

I claim:

1. A watertight manhole insert for positioning beneath a manhole cover, said insert comprising:

a mounting flange corresponding to a support flange of a manhole frame;

a dish-shaped body depressed below said mounting flange less than the path of spin of said manhole cover on said supporting flange of said manhole frame, said body including a recess formed in the lower portion thereof; and a valve located in said recess for releasing pressure which builds up beneath said insert.

2. A watertight manhole insert as defined in claim 1, wherein said valve comprises a stem mounted in the bottom of said recess and a head positioned on the top of said stem.

3. A watertight manhole insert as defined in claim 1, wherein said recess includes an annular space surrounding said valve such that the valve can be grasped and used as a handle to lift the insert from a manhole.

4. A watertight manhole insert as defined in claim 1 further comprising sealing means positioned on the bottom of said mounting flange.

5. A watertight manhole insert as defined in claim 1 further comprising a generally vertical wall between said mounting flange and said disk-shaped body.

6. A watertight manhole insert for positioning in a manhole beneath a manhole cover, said insert comprising:

a mounting flange corresponding to a support flange of a manhole frame, said mounting flange including means for forming a seal between said mounting flange and said support flange;

a dish-shaped body member depressed below said mounting flange less than the path of spin of said manhold cover on said supporting flange of said manhole frame, said body member including a recess formed in the lower portion thereof; and a valve located in said recess for releasing pressure which builds up beneath said insert, said valve being sized such that an annular space is provided in said recess around said valve such that said valve can be grapsed and used as a handle to remove said insert from said manhole.

* * * * *